US011138935B2

(12) United States Patent
Meng et al.

(10) Patent No.: US 11,138,935 B2
(45) Date of Patent: Oct. 5, 2021

(54) DATA VOLTAGE COMPENSATION METHOD, A DISPLAY DRIVING METHOD, AND A DISPLAY APPARATUS

(71) Applicant: BOE TECHNOLOGY GROUP CO., LTD., Beijing (CN)

(72) Inventors: Song Meng, Beijing (CN); Zhongyuan Wu, Beijing (CN); Fei Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 706 days.

(21) Appl. No.: 16/063,916

(22) PCT Filed: Dec. 15, 2017

(86) PCT No.: PCT/CN2017/116541
§ 371 (c)(1),
(2) Date: Jun. 19, 2018

(87) PCT Pub. No.: WO2018/205615
PCT Pub. Date: Nov. 15, 2018

(65) Prior Publication Data

US 2021/0201789 A1 Jul. 1, 2021

(30) Foreign Application Priority Data

May 12, 2017 (CN) ..... 201710336094.3
Aug. 25, 2017 (CN) ..... 201710744950.9

(51) Int. Cl.
*G09G 3/3291* (2016.01)
*G09G 3/3258* (2016.01)

(52) U.S. Cl.
CPC ..... *G09G 3/3258* (2013.01); *G09G 3/3291* (2013.01); *G09G 2320/029* (2013.01); *G09G 2330/12* (2013.01)

(58) Field of Classification Search
CPC ... G09G 3/3258; G09G 3/3291; G09G 3/3233
See application file for complete search history.

(56) References Cited

U.S. PATENT DOCUMENTS

2008/0174574 A1 7/2008 Yoo
2009/0027310 A1 1/2009 Kim
(Continued)

FOREIGN PATENT DOCUMENTS

CN 101079233 A 11/2007
CN 101286298 A 10/2008
(Continued)

OTHER PUBLICATIONS

International Search Report & Written Opinion dated Mar. 15, 2018, regarding PCT/CN2017/116541.
(Continued)

*Primary Examiner* — Sardis F Azongha
(74) *Attorney, Agent, or Firm* — Intellectual Valley Law, P.C.

(57) ABSTRACT

The present application discloses a method for compensating data voltages in a display apparatus. The method for individually compensating a data voltage to be applied to one of the multiple pixel circuits in the display apparatus. The method includes obtaining a threshold voltage of the driving transistor in the one of the multiple pixel circuits. Additionally, the method includes applying a testing voltage to a gate electrode of the driving transistor for charging the sense line up to a first time period to determine a first monitoring voltage associated with the sense line. The testing voltage is set to be a sum of the threshold voltage and a first setting voltage. Moreover, the method includes compensating a data voltage to be applied to the one of the multiple pixel circuits based on the first monitoring voltage and the threshold voltage.

18 Claims, 4 Drawing Sheets

(56) References Cited

U.S. PATENT DOCUMENTS

| | | | | |
|---|---|---|---|---|
| 2014/0176622 | A1 | 6/2014 | Jung et al. | |
| 2015/0138179 | A1 | 2/2015 | Bax et al. | |
| 2015/0294626 | A1 | 10/2015 | Bi et al. | |
| 2016/0189623 | A1 | 6/2016 | Miwa et al. | |
| 2016/0189625 | A1 | 6/2016 | Kim et al. | |
| 2016/0267844 | A1 | 9/2016 | Senda et al. | |
| 2017/0004765 | A1* | 1/2017 | Tani | G09G 3/3233 |
| 2017/0193922 | A1* | 7/2017 | Pyeon | G09G 3/3266 |
| 2017/0206839 | A1 | 7/2017 | Wu et al. | |

FOREIGN PATENT DOCUMENTS

| | | | |
|---|---|---|---|
| CN | 104658474 | A | 5/2015 |
| CN | 105513536 | A | 4/2016 |
| CN | 105513541 | A | 4/2016 |
| CN | 105702206 | A | 6/2016 |
| CN | 105741761 | A | 7/2016 |
| CN | 105761678 | A | 7/2016 |
| CN | 106409225 | A | 2/2017 |
| CN | 106652911 | A | 5/2017 |
| KR | 100901778 | B1 | 6/2009 |
| KR | 20120045252 | A | 5/2012 |
| KR | 20140083680 | A | 7/2014 |
| KR | 20160007898 | A | 1/2016 |
| KR | 20170035058 | A | 3/2017 |

OTHER PUBLICATIONS

First Office Action in the Chinese Patent Application No. 201710744950.9, dated Sep. 24, 2019; English translation attached.

Grant of Patent in the Korean Patent Application No. 20187021038, dated Oct. 22, 2019; English translation attached.

First Office Action in the Japanese Patent Application No. 2018539294, dated Jun. 29, 2021; English translation attached.

* cited by examiner

DATA VOLTAGE COMPENSATION METHOD, A DISPLAY DRIVING METHOD, AND A DISPLAY APPARATUS

CROSS-REFERENCE TO RELATED APPLICATION

This application is a national stage application under 35 U.S.C. § 371 of International Application No. PCT/CN2017/116541, filed Dec. 15, 2017, which claims priority to Chinese Patent Application No. 201710336094.3, filed on May 12, 2017, and Chinese Patent Application No. 201710744950.9, filed Aug. 25, 2017, the contents of which are incorporated by reference in the entirety.

TECHNICAL FIELD

The present disclosure relates to display technology, more particularly, to a data voltage compensation method, a display-driving method, a data-compensation apparatus for implementing the method, and a display apparatus thereof.

BACKGROUND

Electroluminescent device can be used as a self-luminous display device, providing many advantages such as wide viewing angle, high contrast, and fast responding speed. Through the technology development in electroluminescence, organic electroluminescent devices such as organic light-emitting diode (OLED) provide superior brightness, less power consumption, faster response rate, and broader color gamut and become a main stream display devices over traditional inorganic electroluminescent devices.

The driving transistor that controls a current for driving light emission of the OLED has a threshold voltage drift problem, affecting the image quality displayed by OLED. Most conventional designs are using either internal compensation or external compensation to at least partially compensate the threshold voltage drift for enhancing brightness uniformity of display image for the whole display panel. External compensation has some advantages on simplification of pixel circuit structure and display panel fabrication process and can be flexibly adjusted in compensation algorithm to achieve better compensation effect. Yet conventional compensation algorithms still have deficiency in compensating data voltage for individual subpixel, limiting their compensation effects for enhancing display image uniformity.

SUMMARY

In an aspect, the present disclosure provides a method for compensating data voltages in a display apparatus. The display apparatus includes multiple pixel circuits respectively associated with multiple sub-pixels, and each of the multiple pixel circuits includes at least a driving transistor, an organic light-emitting diode (OLED), and a sense line coupled to the driving transistor and the OLED. The method for individually compensating a data voltage to be applied to one of the multiple pixel circuits includes obtaining a threshold voltage of the driving transistor in the one of the multiple pixel circuits. Additionally, the method includes applying a testing voltage to agate electrode of the driving transistor for charging the sense line up to a first time period to determine a first monitoring voltage associated with the sense line. The testing voltage is set to be a sum of the threshold voltage and a first setting voltage. Furthermore, the method includes compensating a data voltage to be applied to the one of the multiple pixel circuits based on the first monitoring voltage and the threshold voltage.

Optionally, the first time period is set to be a same duration for some of the multiple pixel circuits correspondingly for driving respective OLEDs thereof to emit light of a same color and the first setting voltage is set to be a same voltage for each of the some of pixel circuits.

Optionally, either the first time period is set to be a same duration for some of the multiple pixel circuits correspondingly for driving respective OLEDs thereof to emit light of a same color or the first setting voltage is set to be a same voltage for each of the some of the multiple pixel circuits.

Optionally, the obtaining the threshold voltage of the driving transistor includes applying a second setting voltage to the gate of the driving transistor to charge the sense line up to a second time period to determine a second monitoring voltage associated with the sense line.

Optionally, the threshold voltage is determined to be equal to a difference between the second setting voltage and the second monitoring voltage.

Optionally, the method further includes repeating the obtaining a threshold voltage of the driving transistor and the applying a first testing voltage to determine a first monitoring voltage based on a triggering condition to obtain refreshed values of the threshold voltage and the first monitoring voltage. The method additionally includes using the refreshed values for compensating the data voltage to be applied to the one of the multiple pixel circuits.

Optionally, the triggering condition includes at least one selected from receiving a control command to request the repeating; turning on the display apparatus; being a first time before every n frames of images being displayed on the display apparatus, wherein n is a positive integer; and being a second time when a timer starts timing for measuring either the first time period or the second time period.

Optionally, the compensating the data voltage includes making a first adjustment to the data voltage individually due to differences between different threshold voltages of different driving transistors in different pixel circuits correspondingly for driving respective OLEDs thereof to emit light of a same color and making a second adjustment to the data voltage individually due to differences between different device-parameters other than the threshold voltage of different driving transistors in different pixel circuits correspondingly for driving respective OLEDs thereof to emit light of the same color.

Optionally, the compensating the data voltage includes dividing the data voltage to be applied to the one of the multiple pixel circuits by a first parameter and adding a second parameter to obtain a compensated data voltage. The first parameter is equal to a square root of the first monitoring voltage divided by a first constant and the second parameter is equal to a sum of the threshold voltage and a second constant.

In another aspect, the present disclosure provides a method for driving a display apparatus. The display apparatus includes multiple pixel circuits. Each of the multiple pixel circuits includes a driving transistor, an organic light-emitting diode (OLED), and a sense line coupled to the driving transistor and the OLED. The method includes applying a testing voltage individually to a gate of a driving transistor in a pixel circuit of the multiple pixel circuits. The testing voltage is a sum of a threshold voltage of the driving transistor and a first setting voltage. Additionally, the method includes charging the sense line coupled to the driving transistor by charges induced by the testing voltage.

Furthermore, the method includes converting the charges accumulated over a first time period to obtain a first monitoring voltage associated with the sense line. The first monitoring voltage and the testing voltage are used to deduce one or more compensation parameters individually associated with the pixel circuit and used to compensate a data voltage to be applied to the pixel circuit for controlling the OLED thereof to emit light for displaying a subpixel image.

Optionally, the first time period is set to be a same duration for each of some pixel circuits corresponding to some of the multiple sub-pixels for emitting light of a same color and the first setting voltage is set to be a same voltage for each of the some of the multiple pixel circuits.

Optionally, either the first time period is set to be a same duration for each of some pixel circuits corresponding to some of the multiple sub-pixels for emitting light of a same color or the first voltage is set to be a same voltage for each of the some of the multiple pixel circuits.

Optionally, the method further includes applying a second setting voltage to the gate of the driving transistor in the pixel circuit, charging the sense line coupled to the driving transistor by charges induced by the second setting voltage, and converting the charges accumulated over a second time period to obtain a second monitoring voltage associated with the sense line. The second monitoring voltage and the second setting voltage are used for deducing a threshold voltage associated with the driving transistor.

Optionally, the applying, charging, and converting are performed once a triggering condition is met for obtaining refreshed values of the first monitoring voltage and/or the second monitoring voltage for each of the multiple pixel circuits.

Optionally, the triggering condition includes at least one selected from: receiving a control command to request the refreshing; turning on the display apparatus; being a first time before every n frames of image is displayed on the display apparatus, wherein n is a positive integer; and being a second time when a programmed timing cycle starts.

In yet another aspect, the present disclosure provides a data voltage compensation apparatus of a display apparatus. The display apparatus includes multiple pixel circuits. Each of the multiple pixel circuits includes a driving transistor, an organic light-emitting diode (OLED), and a sense line coupled to the driving transistor and the OLED. The compensation apparatus includes one compensator circuit coupled to each of the multiple pixel circuits. The compensator circuit is configured to obtain a threshold voltage individually associated with the driving transistor in one of the multiple pixel circuits. Additionally, the compensator circuit is configured to apply a testing voltage to a gate of the driving transistor for charging the sense line up to a first time period to determine a first monitoring voltage associated with the sense line. The testing voltage is set to be a sum of the threshold voltage and a first setting voltage. Furthermore, the compensator circuit is configured to compensate a data voltage to be applied to the pixel circuit based on the first monitoring voltage and the threshold voltage.

In another aspect, the present disclosure provides a display-driving apparatus for driving a display apparatus. The display apparatus includes multiple pixel circuits. Each of the multiple pixel circuits includes a driving transistor, an organic light-emitting diode (OLED), and a sense line coupled to the driving transistor and the OLED. The display-driving apparatus includes one compensator circuit coupled to each of the multiple pixel circuits. The compensator circuit includes a monitor circuit. The monitor circuit is configured to sense charges in the sense line coupled to the driving transistor of one of the multiple pixel circuits induced by a testing voltage applied to a gate of the driving transistor. Additionally, the monitor circuit is configured to convert charges accumulated over a first time period to a readout voltage as a first monitoring voltage individually associated with the pixel circuit.

In another aspect, the present disclosure provides a display apparatus comprising a data signal compensation apparatus described herein and a display-driving apparatus described herein.

In another aspect, the present disclosure provides a display apparatus comprising a data signal compensation apparatus described herein.

In another aspect, the present disclosure provides display apparatus comprising a display-driving apparatus described herein.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Accordingly, the present disclosure provides, inter alia, a data voltage compensation method, a display-driving method, a data-compensation apparatus for implementing the method, and a display apparatus thereof that substantially obviate one or more of the problems due to limitations and disadvantages of the related art. In one aspect, the present disclosure provides a data voltage compensation method in a display apparatus.

Figure 1:
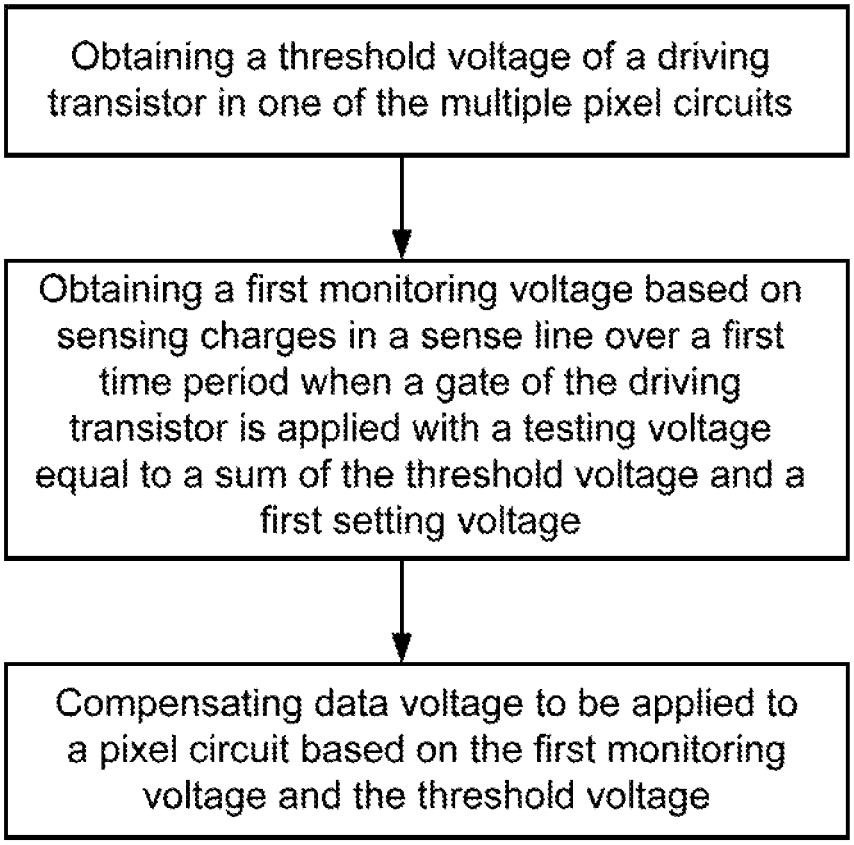
FIG. 1 is a flow chart showing a method of compensating data voltage for image display in a display apparatus according to some embodiments of the present disclosure.

FIG. 1 is a flow chart showing a method of compensating data voltage for image display in a display apparatus according to some embodiments of the present disclosure. Here, the display apparatus is general purpose image display apparatus. Optionally, the display apparatus includes multiple pixel circuits respectively associated with multiple sub-pixels. Each of the multiple pixel circuits includes at least a driving transistor, an organic light-emitting diode (OLED), and a sense line coupled to the driving transistor and the OLED. In particular, the OLED is associated with an individual subpixel and is configured to emit light of a color. Optionally, in the display apparatus, the light emitted from an OLED can have any one color selected from red, yellow, green, blue, purple, pink, brown, and white or others. Based on different color of the light emitted from the OLED, the multiple pixel circuits can be separated from each other. In each pixel circuit, a gate of the driving transistor is used to apply a data voltage to drive the driving transistor to connect a source to a drain thereof to couple with the sense line and one electrode of the OLED for controlling the light emission. The data voltage, as if is compensated through the method described hereafter, is able to drive the display apparatus for displaying images with improved uniformity.

Referring to FIG. 1, the method of compensating the data voltage is implemented to each individual pixel circuit of the multiple pixel circuits in the display apparatus. In an embodiment, the method includes obtaining a threshold voltage of the driving transistor in the one of the multiple pixel circuits. The method further includes applying a testing voltage to a gate electrode of the driving transistor for charging the sense line up to a first time period to determine a first monitoring voltage associated with the sense line. The testing voltage is set to be a sum of the threshold voltage and a first setting voltage. Additionally, the method includes compensating a data voltage to be applied to the one of the multiple pixel circuits based on the first monitoring voltage and the threshold voltage.

As one of applications of the method of data voltage compensation, the data voltage to be applied to each individual pixel circuit is compensated before it is applied to the gate of the corresponding driving transistor. The data voltage is compensated specifically for the particular pixel circuit. After compensation, the data voltage is still applied to the same pixel circuit originally intended to apply. Different pixel circuit may correspond to different threshold voltage of the driving transistor thereof and different first monitoring voltage. The compensation process associated with one pixel circuit at least includes some calculations being independent from the calculations for other pixel circuits. However, individual compensation does not mean that different data voltage compensations for different pixel circuits must be separately performed in time and procedure. Instead, the method allows the first monitoring voltage associated with each pixel circuit can be obtained simultaneously through a single procedure. Optionally, a same one processor can be used to process multiple data voltage compensations corresponding to multiple pixel circuits in parallel.

Optionally, the processor used to execute the method of FIG. 1 for data voltage compensation can be a data driver, a time controller (TCON), a logic circuit capable of performing at least partial calculation, a processor disposed in the display apparatus, a processor disposed in an external apparatus coupled to the display apparatus, and others. Optionally, the display apparatus can be any one of a display panel, a smart phone, a tablet computer, a TV, a displayer, a notebook computer, a digital picture frame, a navigator or any product or component having a display function. Optionally, the processor can be implemented in an application-specific integrated circuit (ASIC), a digital signal processor (DSP), a digital signal processing device (DSPD), a programmable logic device (PLD), a field programmable gate array (FPGA), a central processing unit (CPU), a controller, a microcontroller, and others. Optionally, some kinds of readable storage media with embedded programs can be included to work together with the processor mentioned above to execute the method of data voltage compensation according to some embodiments of the present disclosure.

Optionally, the method of obtaining the threshold voltage of the driving transistor can be read from a storage media (originated from a factory setting, a user setting, or a testing result, etc.), obtained by monitoring the pixel circuit, or received from an external apparatus, and others.

Optionally, the method of obtaining the first monitoring voltage associated with the pixel circuit can be read from a storage media, obtained by monitoring the pixel circuit, or received from an external apparatus, and others. The value of the first monitoring voltage obtained from a charging voltage for charging the sense line over a first time period after applying the testing voltage to the gate of the driving transistor can be deduced using a main processor entity specifically designed for executing the method. Alternatively, the value of the first monitoring voltage can be obtained from other processor entity first and is transferred to the main processor entity. The process of obtaining a value of the first monitoring voltage can be executed at any time incorporated with the method of compensating the data voltage to be applied to the one of the multiple pixel circuits based on the first monitoring voltage and the threshold voltage.

Referring to FIG. 1, the testing voltage is set to be a sum of the threshold voltage $V_{th}$ and a first setting voltage $V_0$. Then, a source-to-drain current $I_{DS}$ of the driving transistor with its gate being applied with the testing voltage can be expressed as (assuming that a reference voltage on the sense line is 0 V):

$$I_{DS}=K(V_0+V_{th}-V_{th})^2=KV_0^2$$

Figure 2:
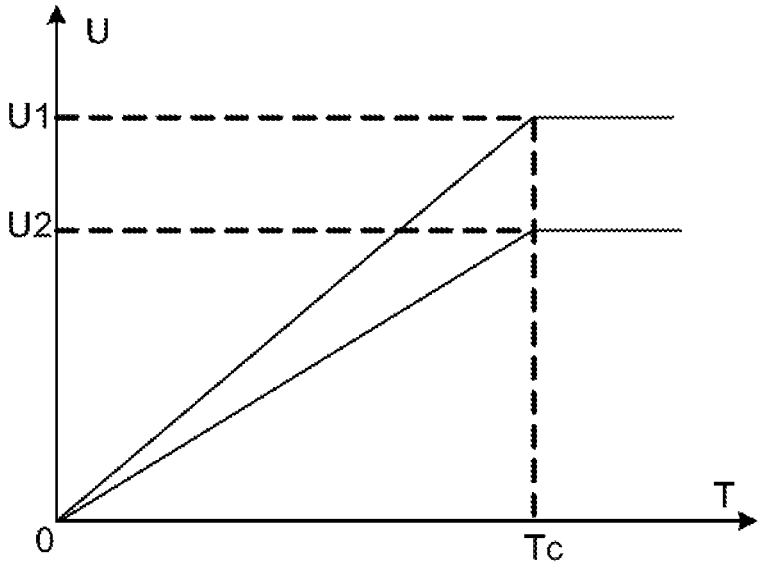
FIG. 2 is a schematic diagram showing voltage variation over time during a capacitor charging process according to some embodiments of the present disclosure.

As seen from the formula, the current $I_{DS}$ is independent from the value of threshold voltage V but only depended on the value of the first setting voltage $V_0$ (a known value) and the parameter K. The sense line is connected to the driving transistor and the organic light-emitting diode (OLED). When the OLED is kept in a state of non-emission (e.g., under reversed biasing), the source-to-drain current $I_{DS}$ can be utilized to charge the sense line. Now the sense line is acted as one terminal of a capacitor. Under a condition that the charging time. e.g., a first time period, is sufficiently short, a voltage value of the charged sense line is positively correlated to the source-to-drain current Is. As shown in FIG. 2, different charging currents are charging a same capacitor to different voltages (vertical coordinate) up to a same time period (horizontal coordinate) and are stopped at Tc. In the process, the rate of voltage increase is differently affected by different charging current. When charging the same capacitor for a same time period ended at Tc, a final higher voltage value U1 corresponds to a larger charging current applied and a final lower voltage value U2 corresponds to a smaller charging current. Therefore to some degrees, the value of the first monitoring voltage, which is related to the charged voltage in the sense line, is able to reflect a value of K, which is proportional to the source-to-drain current $I_{DS}$. The parameter K can be expressed as:

$$K=\frac{1}{2}\cdot\frac{W}{L}\cdot\mu\cdot C_{ox}$$

Here, K is dependent upon the channel width W, length L, of the driving transistor, and is also dependent upon the parameters related to carrier mobility μ and capacitance $C_{ox}$ of the gate insulation layer per unit area. Therefore, different value of the first monitoring voltage associated with different driving transistors in different pixel circuits can reflect difference in K values of different driving transistors. The first monitoring voltage obtained through the method of the present disclosure provides another parameter for monitoring the driving transistor. Optionally, in order to use the first monitoring voltage to more accurately reflect the difference in K values of different driving transistors in different pixel circuits correspondingly for driving respective OLEDs thereof to emit light of a same color, it is preferred to set the first time period used to charging the sense line a same duration for each of some of the multiple pixel circuits correspondingly for driving respective OLEDs thereof to emit light of a same color. At the same time, it is preferred to set the first setting voltage $V_0$ to be a same voltage for each of some of the multiple pixel circuits correspondingly for driving respective OLEDs thereof to emit light of a same color. Or in an alternative embodiment, only one of above two set parameters, i.e., the first time period for charging the sense line and the first setting voltage $V_0$, is set to be a same value for each of some of the multiple pixel circuits correspondingly for driving respective OLEDs thereof to emit light of a same color. For pixel circuits correspondingly for driving respective OLEDs thereof to emit light of different color, the setting of the first time period and the first setting voltage can be arbitrary depending on specific applications.

Optionally, the method of compensating the data voltage includes providing a uniform driving current for respective OLEDs when a same data voltage is applied to all driving transistors of different pixel circuits correspondingly for driving respective OLEDs thereof to emit light of a same color. Because of the driving current variation among different OLEDs in different pixel circuits is mainly originated from the variations among different driving transistors in these pixel circuits, the values of the threshold voltage obtained according to the method of the present disclosure can individually reflect the threshold voltage variations of the driving transistors. The threshold voltage value obtained according to the method can be used to substantially accurately compensate the driving current deviations caused by the threshold voltage variations of the driving transistors. At the same time, the values of the first monitoring voltage obtained according to the method of the present disclosure can compensate the driving current deviations caused by variations of other parameters (other than threshold voltage) of the driving transistors. Of course, these compensations can be realized not only for pixel circuits configured to emit light of a same color but also for pixel circuits configured to emit light of different colors, based on a same method.

In another aspect, the present disclosure provides a method for driving a display apparatus including multiple pixel circuits. Each of the multiple pixel circuits includes a driving transistor, an organic light-emitting diode (OLED), and a sense line coupled to the driving transistor and the OLED. The method includes applying a testing voltage individually to a gate of a driving transistor in a pixel circuit of the multiple pixel circuits. The testing voltage is a sum of a threshold voltage of the driving transistor and a first setting voltage. The method further includes charging the sense line coupled to the driving transistor by charges induced by the testing voltage. Additionally, the method includes converting the charges accumulated over a first time period to obtain a first monitoring voltage associated with the sense line. The first monitoring voltage and the testing voltage are used to deduce one or more compensation parameters individually associated with the pixel circuit and used to compensate a data voltage to be applied to the pixel circuit for controlling the OLED thereof to emit light for displaying a subpixel image with desired brightness.

Figure 3:
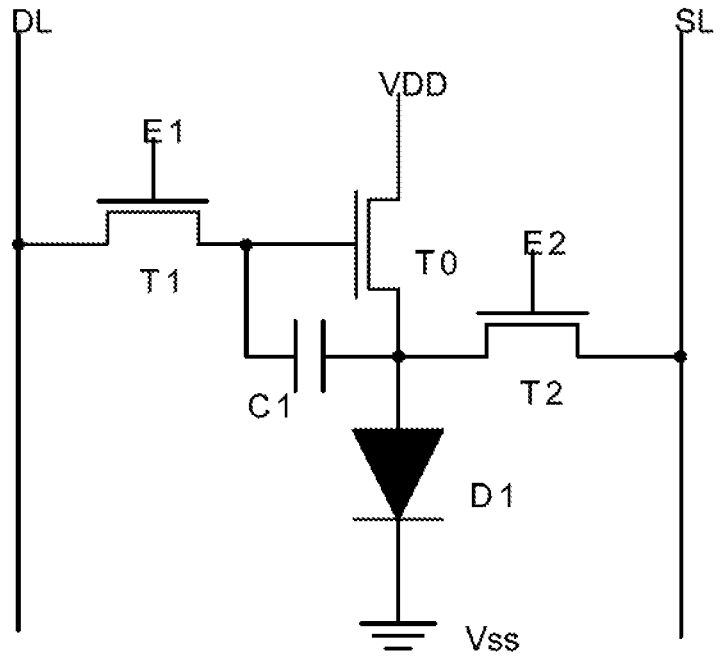
FIG. 3 is a simplified diagram of a pixel circuit according to an embodiment of the present disclosure.

FIG. 3 is a simplified diagram of a pixel circuit according to an embodiment of the present disclosure. FIG. 3 shows an example of the pixel circuit in the display apparatus that is driven by the method disclosed above. Referring to FIG. 3, the pixel circuit includes a driving transistor T0, a first transistor T1, a second transistor T2, a storage capacitor C1, and an organic light-emitting diode D1. The first transistor T1 includes a gate coupled to a first row of scan line E1, a first electrode coupled to a data line DL, and a second electrode coupled to the gate of the driving transistor. The first transistor T1 is configured to connect or disconnect the data line DL to or from the gate of the driving transistor T0 under controls of the voltage signal from the first row of scan line E1. The second transistor 12 includes a gate coupled to a second row of scan line E2, a first electrode coupled to the second electrode of the driving transistor T0 and a first electrode of the organic light-emitting diode D1, and a second electrode coupled to the sense line SL. The second transistor T2 is configured to connect or disconnect the second electrode of the driving transistor T0 to or from the sense line SL under controls of the voltage signal from the second row of scan line E2. The storage capacitor C1 is disposed between the gate and the second electrode of the driving transistor T0 and is configured to store a data voltage applied to the pixel circuit. The storage capacitor C1 is also configured to clamp the gate and the second electrode with a voltage bootstrapping effect.

Additionally, the first electrode of the driving transistor T0 is coupled to a bias voltage line VDD. The second electrode of the organic light-emitting diode D1 is coupled to a reference voltage line Vss. Optionally, the first electrode and the second electrode of each transistor mentioned above can be either a source electrode or a drain electrode, which are symmetrically laid therein. Optionally, the source electrode and the drain electrode can be set properly to respective first electrode or second electrode based on specific transistor type to match the current direction accordingly.

In an embodiment, the display apparatus includes multiple pixel circuits arranged in a matrix with multiple rows and columns. Each row of pixel circuits shares a same (first) row of scan line E1 and a same (second) row of scan line E2. Each column of pixel circuits shares a same sense line SL and a same data line DL. Accordingly, at least one process of applying data voltage to the pixel circuits, compensating the data voltage, and monitoring the data-compensation parameters to a particular pixel circuit in the matrix can be performed according to its row/column address therein.

Conventionally, the data voltage compensation is performed in following process: setting a target voltage value based on emission brightness of pixel circuit, obtaining a voltage difference between a voltage value read from the charged sense line and the target voltage value, using the voltage difference as a feedback parameter to adjust the data voltage, and making the voltage value read from the sense line to be closer and closer to the target voltage level as time goes to make the pixel circuit to drive light emission with the preset emission brightness. In reality, it takes a very long time to make the voltage value read from the sense line to reach the target voltage value while shortening the time makes the compensation effect poor. Additionally, the target voltage values for some emission brightness especially low grayscale emission brightness need to be calculated using other target voltage values for other emission brightness, which are usually deviated far from actual voltage value and poor in compensation effect.

In the embodiment of the present disclosure, the method for driving the display apparatus by monitoring individual data-compensation parameter associated with each of the multiple pixel circuits includes: sensing a voltage value from the charged sense line induced by a testing voltage applied to the gate of the driving transistor up to a first time period, and reading out the voltage value in the sense line as a first monitoring voltage.

Referring to FIG. 3 shown with one pixel circuit in the display apparatus, the method of driving the display apparatus includes using the voltage signals on the first row scan line E1 and the second row scan line E2 to respectively turn on the first transistor T1 and the second transistor T2, applying a testing voltage through the data line DL to the gate of the driving transistor T0. Then, method includes, starting from a time point, setting the sense line to a floating state, generating a current flown from the bias voltage line VDD through the first electrode and the second electrode of the driving transistor T0 and further through the first electrode and the second electrode of the second transistor T2 to charge the sense line SL. After the first time period counted from the time point, the method further includes controlling the voltage signal at the second row scan line E2 to turn off the second transistor T2 so that a voltage value in the charged sense line can be read out as the first monitoring voltage.

Figure 4:
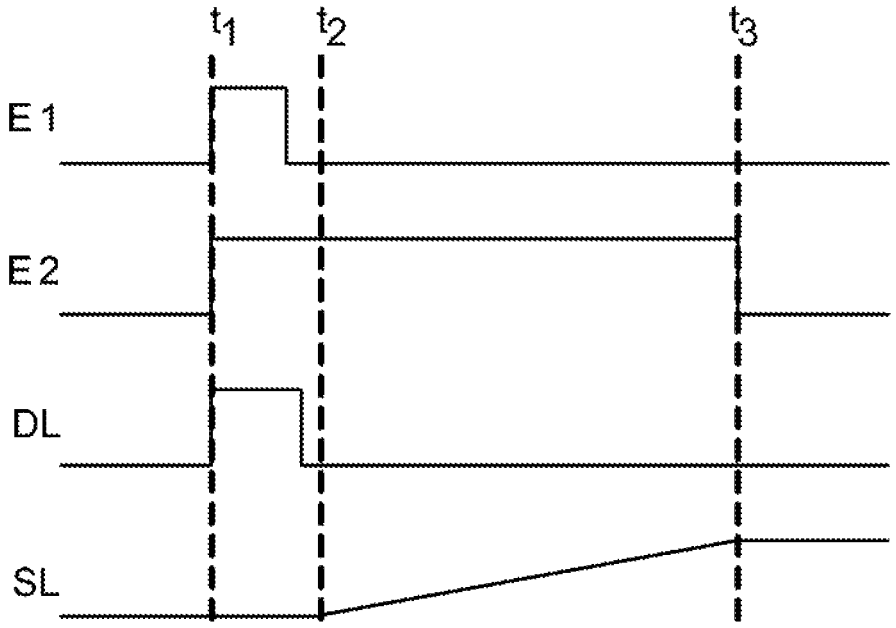
FIG. 4 is a timing diagram of operating the pixel circuit according an embodiment of the present disclosure.

FIG. 4 is a timing diagram of operating the pixel circuit of FIG. 3 according an embodiment of the present disclosure. Referring to FIG. 3 and FIG. 4, at a first time point t, the first row scan line E1 is applied with a high-voltage signal to turn on the first transistor T1 and the second row scan line E2 is also applied with a high-voltage signal to turn on the second transistor T2. At the same time, the data line DL is applied with the testing voltage. From this time t1 and on, the two electrodes of the storage capacitor C1 will be written to a voltage difference equal to the testing voltage, which is maintained there. At a second time point t2, when the first row scan line E1 is changed to apply a low-voltage signal and the data line DL stops applying the testing voltage, the gate of the driving transistor T0 is in a floating state. (In another embodiment, the second time point t2 can be set at a moment when the data line stops applying the testing voltage or the first row scan line E1 is switching from a switch-on voltage level for T1 to a switch-off voltage level). From t2 and on, due to the charge-retention effect of the storage capacitor C1, the two electrodes of C1 continues to keep the voltage difference equal to the testing voltage to charge the sense line started from t2 when the sense line is set to a floating state. The current $I_{DS}$ is kept at a constant value independent from the threshold voltage $V_{th}$ of the driving transistor T0. As the charging continues, the voltage value in the sense line increases at a constant rate until a third time point t3 when the second row scan line E2 is switched to a low-voltage signal.

Referring to FIG. 4, it can be seen from the diagram, that the voltage value read in the sense line SL is the first monitoring voltage equal to a product of the first time period from t2 to t3 (i.e., t3-t2) and the $I_{DS}$ at a substantially constant value. Therefore, the first monitoring voltage is independent from the threshold voltage $V_{th}$ of the driving transistor T0 so that it can reflect the value of parameter K associated with the driving transistor T0. In the embodiment, the length of the first time period can be set by setting either t2 and/or t3. In order to avoid the parasitic capacitance of the sense line is fully charged too early to lead a value of the first monitoring voltage that does not accurately reflect the value of parameter K, the first time period can be set based on the parasitic capacitance value of the sense line SL. Accordingly, the voltage value read from the sense line is still increasing with a constant rate before the third time point 3.

Figure 5:
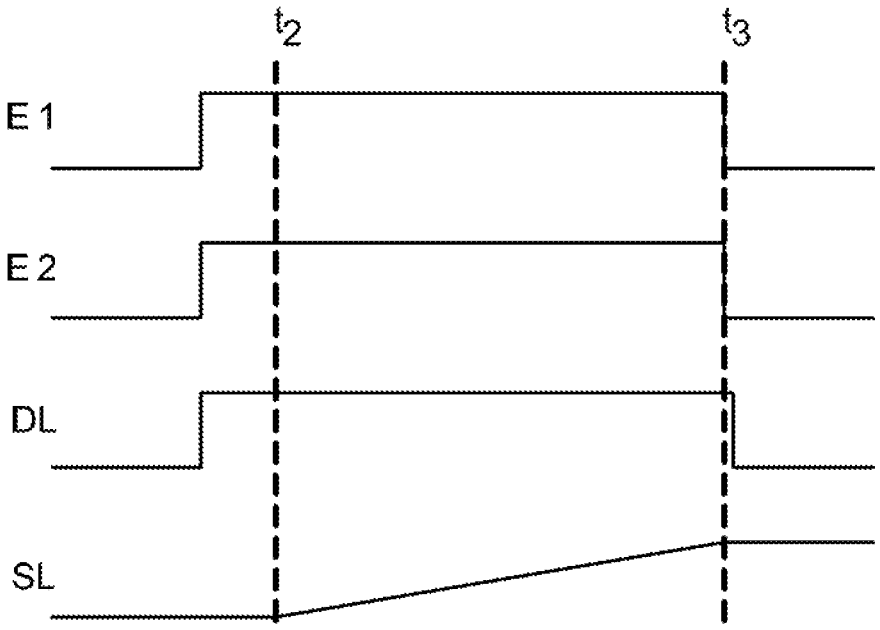
FIG. 5 is a timing diagram of operating the pixel circuit according to another embodiment of the present disclosure.

FIG. 5 is a timing diagram of operating the pixel circuit according to another embodiment of the present disclosure. Referring to FIG. 5, the timing of operating the pixel circuit is changed. At any time between the second time point t2 and the third time point t3, the first row scan line E1 is kept a switch-on voltage level for the first transistor T1. The data line DL is applying the testing voltage during this time period. Unlike the embodiment shown in FIG. 4, the voltage difference between the two electrodes of the storage capacitor C1 will change during the time period between t2 and t3. If this time period is sufficiently long, the voltage value read from the sense line SL will increase with a faster rate at the beginning and gradually increase with slower rates later on. By setting the time period sufficiently short, the voltage value read from the sense line can still be considered to increase with a proximately constant rate. Based on this, the first monitoring voltage can be obtained and be considered to still reflect the value of parameter K associated with the driving transistor T0.

In general, the method of compensating the data voltage can be performed by using an one-step calculation. The time needed for making the data voltage compensation is substantially reduced comparing to gradually approaching the target voltage value in the conventional compensation scheme. It also overcomes some drawbacks of poor compensation effect due to large deviation from actual voltage levels for small emission brightness subpixels. Many more advantages of the method of the present disclosure can be found throughout the specification and particularly below.

In an embodiment, the method of obtaining the threshold voltage of the driving transistor can be obtained from values of a second monitoring voltage and a second setting voltage. In particular, the second monitoring voltage is a voltage value read from the sense line being charged over a second time period when a second setting voltage is applied to the gate of the driving transistor. The second setting voltage and the second monitoring voltage are used to calculate the threshold voltage of the driving transistor. The monitoring process of data-voltage compensation parameters can include both the process of obtaining the first monitoring voltage and the process of obtaining the second monitoring voltage. In the embodiment, the threshold voltage can be obtained by taking a difference between the second setting voltage and the second monitoring voltage.

Optionally, this process can be executed by the main processor entity that used for performing data voltage compensation or can be performed by other processor entities which pass the information of the readout value back to the main processor entity for the data voltage compensation. Optionally, this process can be implemented any time before the main processor entity to perform the step of compensating the data voltage shown in FIG. 1. Optionally, the process of obtaining the threshold voltage value and the process of obtaining the first monitoring voltage can be implemented within a certain time range executed without fixing timing priority in process. Optionally, the process of obtaining the first monitoring voltage and the process of obtaining the second monitoring voltage also can be implemented within a certain time range executed without fixing timing priority in process. Optionally, the threshold voltage used in the testing voltage applied to the gate of driving transistor for obtaining the first monitoring voltage can be obtained any time before the testing voltage is applied. Optionally, the process of applying a second setting voltage to the gate of driving transistor for obtaining a refreshed threshold voltage may be performed but not necessary every time before the process of applying the testing voltage to include the refreshed threshold voltage for obtaining the first monitoring voltage.

Figure 6:
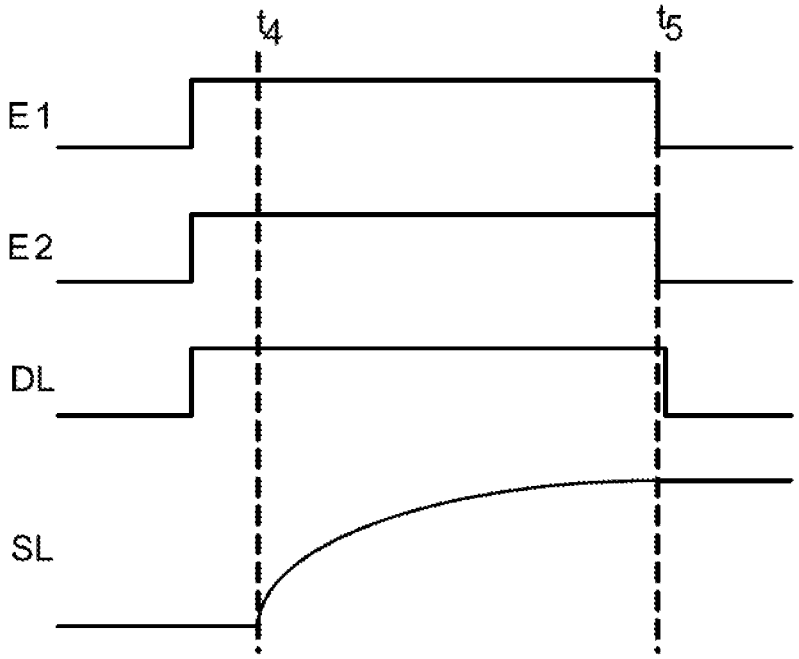
FIG. 6 is a timing diagram of operating the pixel circuit according to yet another embodiment of the present disclosure.

FIG. 6 is a timing diagram of operating the pixel circuit according to yet another embodiment of the present disclosure. Referring to FIG. 6 and using the pixel circuit of FIG. 3 as an example, an operation step of the pixel circuit includes, before a fourth time point t4, controlling voltage signals applied to the first row scan line E1 and the second row scan line E2 to respectively turn on the first transistor T1 and the second transistor T2. Then, another operation step includes applying a second setting voltage through the data line DL to the gate of the driving transistor T0. At the fourth time point t4, the sense line SL is set to a floating state so that a current flown from the bias voltage line VDD through the first electrode and the second electrode of the driving transistor T0 and further through the first electrode and the second electrode of the second transistor T2 is charging the sense line SL. When no current flows through the organic light-emitting diode D1, the above charging process will push the voltage level higher and higher at the second electrode of the driving transistor T0 until the driving transistor is blocked. Then, the voltage difference between the gate and the second electrode of the driving transistor T0 will be kept a constant equal to the threshold voltage of the driving transistor. Another time point t5 after the fourth time point t4 is defined as a time point when switching the voltage signal applied to the second row scan line E2 from a switch-on signal to a switch-off signal. With t5 and t4 time points, a second time period is defined as t5-t4. By setting the second time period sufficiently long, the voltage value on the sense line being charged by the applied second setting voltage can be read out as the second monitoring voltage. As a result, the threshold voltage of the driving transistor can be obtained by using the second setting voltage to subtract the second monitoring voltage. Optionally, at least another way to ensure no current is flowing through the organic light-emitting diode D1 during above process is to add a transistor to disconnect the second electrode of the driving transistor T0 and the first electrode of the organic light-emitting diode D1. Other options are possible.

Thus, based on above operation steps of the pixel circuit for driving the display apparatus are able to obtain the threshold voltage value of the driving transistor in the pixel circuit. Further, the threshold voltage can be used in the method of data voltage compensation to compensate the data voltage to be applied to the same pixel circuit. For the multiple pixel circuits arranged in a form of matrix in the display apparatus, the threshold voltage values of each row of pixel circuits can be obtained one by one based on corresponding row/column address. Additionally, for each individual pixel circuit, the voltage value read from each corresponding sense line during above process for obtaining the second monitoring voltage by applying a second setting voltage to the gate of driving transistor can be further corrected to remove system errors and noise signals to obtain the final threshold voltage value with improved measurement accuracy.

In the method of data voltage compensation and the method of driving the display apparatus with data voltage compensation, the values of the threshold voltage and the first monitoring voltage can be refreshed from time to time whenever a triggering condition is satisfied. The step of compensating the data voltage to be applied to pixel circuit in the method of data voltage compensation can be performed using the most refreshed values of the threshold voltage and the first monitoring voltage obtained in latest operation. The step of monitoring data-voltage compensation parameter associated with each driving transistor of corresponding one of the multiple pixel circuits can be performed at least once whenever the triggering condition is satisfied.

In an example, a step of monitoring the data-voltage compensation parameter can be performed once at a first time point before displaying every frame of image of the display apparatus. This is equivalent to set a time point of monitoring compensation parameter within each frame of image. Performing the step leads to a first monitoring voltage and/or a second monitoring voltage which can be used for performing data voltage compensation within the frame of image. Optionally, a step of monitoring the data-voltage compensation parameter can be performed once at a first time point before displaying every n frames of images of the display apparatus. The step leads to a first monitoring voltage and/or a second monitoring voltage which can be used for performing data voltage compensation in a time period for displaying next n frames of images after the first time point. Here, n can be a positive integer equal to and greater than 1. In other words, the refresh cycle for monitoring data voltage compensation parameter is depended on the display cycle. Of course, the refresh cycle for monitoring data voltage compensation parameter can also be independent to the display cycle. For example, the refresh cycle for monitoring data voltage compensation parameter can be set by a timer, e.g., one day, or one week. The display apparatus can be programmed to perform the step of monitoring data voltage compensation parameter once at a second time point after the timer starts its cycle at a present time. The values of the first monitoring voltage and/or the second monitoring voltage obtained thereof can be used to compensate the data voltage within the cycle set by the timer.

In another example, a step of monitoring the data-voltage compensation parameter can be performed once at a first time point when starting the display apparatus. Performing the step leads to a first monitoring voltage and/or a second monitoring voltage which can be used for performing data voltage compensation before they are refreshed next time. In yet another example, a step of monitoring the data-voltage compensation parameter can be performed once at a first time point when the display apparatus receives a shut-off instruction. Performing the step leads to a first monitoring voltage and/or a second monitoring voltage which can be used for performing data voltage compensation before they are refreshed next time. In still another example, a step of monitoring the data-voltage compensation parameter can be performed once at a first time point when the display apparatus receives a control instruction to trigger the refreshing of the data compensation parameter. The control instruction may be originated from a user input or from other equipment within the display apparatus or from an external apparatus outside the display apparatus. Performing the step leads to a first monitoring voltage and/or a second monitoring voltage which can be used for performing data voltage compensation before they are refreshed next time. In general, an arbitrary combination of all possible triggering conditions mentioned in above examples can be implemented for performing the step to obtain refreshed values of threshold voltage and the first monitoring voltage in order to perform individual data voltage compensation for each pixel circuit in the display apparatus.

In a specific example of the data voltage compensation, provided with the data voltage to be applied to the pixel circuit is $V_{data}$, the compensated data voltage can be obtained by dividing the $V_{data}$ by a first parameter then adding a second parameter. The first parameter is selected to be a square root of the first monitoring voltage ($V_{s1}$) dividing a first constant=$a\sqrt{b}$. The second parameter is selected to be the threshold voltage ($V_{th}$) plus a second constant=0 or a small error correction value. Here a is preset reference value and b is a coefficient satisfying a relationship of an expected emission brightness L versus the data voltage $V_{data}$: $L=bV_{data}^2$. Therefore, based on the preset constant value of a and b, and obtained values of $V_{s1}$ and $V_{th}$, a compensated data voltage can be obtained on the basis of original data voltage $V_{data}$.

In another specific example of the data voltage compensation, provided with the data voltage to be applied to the pixel circuit is $V_{data}$, a corresponding emission brightness L can be calculated. Dividing L by the first monitoring voltage $V_1$ obtains a quotient value. The compensated data voltage can be obtained by taking a square root of the quotient value and multiplying a preset constant value a before adding the threshold voltage value $V_{th}$. Here the emission brightness L can be obtained using the relationship of $L=bV_{data}^2$. Alternatively, the emission brightness L can be obtained using a function of $L=f(GL_{in})$, where $GL_{in}$ is a grayscale value of an image signal or video signal corresponding to original data voltage. f is a function for converting the grayscale value to a brightness value and is determined by a gamma curve (brightness coefficient curve) to be realized by the display apparatus. The f function is different when the gamma curve varies. Note, the method of compensating the data voltage of the present disclosure does not need to the process of how to obtain the original data voltage.

In an example for setting the constant value a, based on the calculation scheme of obtaining the compensated data voltage $V_{cp}$ samples of the display apparatus can be selected to test. Using a value of $V_{cp}$ corresponding to target compensation effect, calculated values of $V_{s1}$ and L, and measured value of $V_{th}$, the value of a can be calculated and set for usage in all data voltage compensation of the display apparatus of the same kind.

Optionally, the constant a being set above is used for driving all pixel circuits in the display apparatus correspondingly for emitting light of a same color. The value of a can still be adjusted during general operation of the display apparatus. Additionally, other parameters associated with each pixel circuit in the display apparatus correspondingly for emitting light of a same color include at least one of the first time period (for charging the sense line), the first setting voltage (for making up the testing voltage), the second setting voltage (for determining the second monitoring voltage), the first parameter, and the second parameter.

Figure 7:
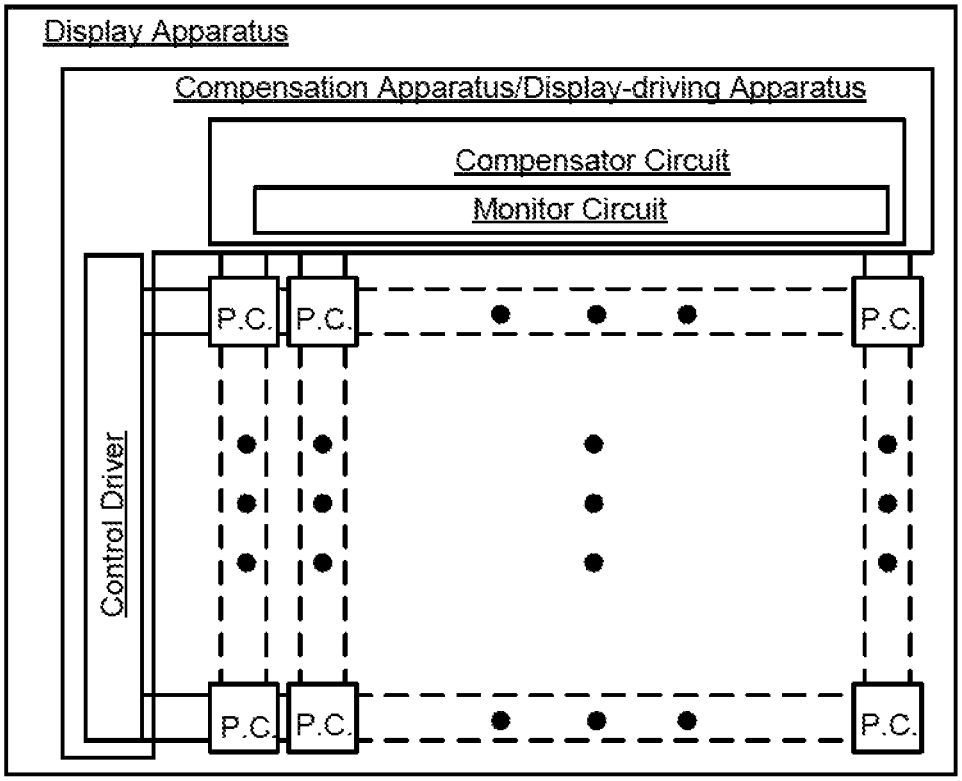
FIG. 7 is a schematic block diagram of the display apparatus having a compensation/display-driving apparatus coupled to multiple pixel circuits according to some embodiments of the present disclosure.

In another aspect, the present disclosure provides a data voltage compensation apparatus in a display apparatus including multiple pixel circuits. Each of the multiple pixel circuits includes a driving transistor, an organic light-emitting diode (OLED), and a sense line coupled to the driving transistor and the OLED. FIG. 7 shows a schematic block diagram of the display apparatus having a compensation apparatus coupled to multiple pixel circuits according to some embodiments of the present disclosure. The compensation apparatus includes one compensator circuit coupled to each pixel circuit (P.C.) for performing individual data voltage compensation. Optionally, each P.C. is substantially similar to one pixel circuit described in FIG. 3. The compensator circuit is configured to obtain a threshold voltage individually associated with the driving transistor in one of the multiple pixel circuits. Additionally, the compensator circuit is configured to apply a testing voltage to a gate of the driving transistor for charging the sense line up to a first time period to determine a first monitoring voltage associated with the sense line. Optionally, the compensation apparatus includes a control driver configured with the compensator circuit to generate one or more control voltage signals including one for controlling the first transistor T1 and the second transistor T2 in each pixel circuit and one or more testing voltage or first setting voltage for the data voltage compensation operation. Optionally, the compensation apparatus is configured to generate all these voltage signals. The testing voltage is set to be a sum of the threshold voltage and a first setting voltage. Moreover, the compensator circuit is configured to compensate a data voltage to be applied to the pixel circuit based on the first monitoring voltage and the threshold voltage.

Optionally, for each of some pixel circuits corresponding to some of the multiple sub-pixels for emitting light of a same color the first time period of charging the sense line is set to be a same duration and the first setting voltage is set to be a same voltage. Optionally, for each of some pixel circuits corresponding to some of the multiple sub-pixels for emitting light of a same color either the first time period of charging the sense line is set to be a same duration or the first setting voltage is set to be a same voltage.

Optionally, the threshold voltage of the driving transistor is obtained each time based on a second monitoring voltage and a second setting voltage. The second monitoring voltage is a voltage value read from the sense line charged by applying the second setting voltage to the gate of the driving transistor over a second time period. Optionally, the threshold voltage is obtained by subtracting the second monitoring voltage from the second setting voltage.

Optionally, obtaining the threshold voltage and/or the first monitoring voltage is refreshed whenever a triggering condition is satisfied. The compensator circuit in the data voltage compensation apparatus is configured to performing data voltage compensation based on the refreshed values of the threshold voltage and the first monitoring voltage obtained in latest monitoring operation.

Optionally, the compensator circuit is configured to compensate a deviation caused by difference in threshold voltages of different driving transistors among different pixel circuits correspondingly for driving OLEDs thereof to emit light of a same color. Additionally, the compensator circuit is configured to compensate another deviation caused by difference in other parameters other than the threshold voltage associated with the driving transistors among different pixel circuits correspondingly for driving OLEDs thereof to emit light of a same color.

In yet another aspect, the present disclosure provides a display-driving apparatus for a display apparatus including multiple pixel circuits. Each of the multiple pixel circuits includes a driving transistor, an organic light-emitting diode (OLED), and a sense line coupled to the driving transistor and the OLED. FIG. 7 also shows a schematic block diagram of the display apparatus having a display-driving apparatus coupled to multiple pixel circuits according to some embodiments of the present disclosure. The display-driving apparatus includes one compensator circuit coupled to each of the multiple pixel circuits. Optionally, each pixel circuit (P.C.) is substantially similar to one pixel circuit described in FIG. 3. Optionally, the compensator circuit includes a monitor circuit. Optionally, the display-driving apparatus includes a control driver to generate one or more control voltage signals including one for controlling the first transistor T1 and the second transistor T2 in each pixel circuit. Optionally, the display-driving apparatus is further configured to coupled the control driver with the compensator circuit and further with the monitor circuit to generate one or more testing voltage, a first setting voltage, and a second setting voltage for the data voltage compensation operation as well as compensation parameter monitoring operation. Optionally, the display-driving apparatus is configured to generate all these voltage signals. Additionally, The monitor circuit is configured to sense charges in the sense line coupled to the driving transistor of one of the multiple pixel circuits induced by a testing voltage applied to a gate of the driving transistor. Furthermore, the monitor circuit is configured to convert charges accumulated over a first time period to a readout voltage as a first monitoring voltage individually associated with the pixel circuit. Furthermore, the monitor circuit is configured to sense charges in the sense line coupled to the driving transistor of one of the multiple pixel circuits induced by a second setting voltage applied to the gate of the driving transistor and convert charges accumulated over a second time period to a readout voltage as a second monitoring voltage individually associated with the pixel circuit. The second monitoring voltage and the second setting voltage are used to determine a threshold voltage of the driving transistor. Moreover, the monitor circuit is configured to perform the monitoring operation above at least once based on a triggering condition. The triggering condition includes at least one selected from selected from receiving a control command to request the refreshing; turning on the display apparatus; being a first time before every n frames of image is displayed on the display apparatus, where n is a positive integer; and being a second time when a programmed timing cycle starts. The refreshed values of the threshold voltage and the first monitoring voltage obtained in the latest monitoring operation will be used by the compensator circuit of the display-driving apparatus to perform data voltage compensation.

In still another aspect, the present disclosure provides a display apparatus including a data signal compensation apparatus described herein and a display-driving apparatus described herein. Alternatively, the present disclosure provides a display apparatus comprising a data signal compensation apparatus described herein. Alternatively, the present disclosure provides a display apparatus including a display-driving apparatus described herein. Optionally, the display apparatus can be one of smart phone, tablet computer, TV, displayer, notebook computer, digital picture frame, navigator, or any product and component having a display function.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method for compensating data voltages in a display apparatus, wherein the display apparatus includes multiple pixel circuits respectively associated with multiple sub-pixels, and a respective one of the multiple pixel circuits includes at least a driving transistor, an organic light-emitting diode (OLED), and a sense line coupled to the driving transistor and the OLED, the method for individually compensating a data voltage to be applied to one of the multiple pixel circuits comprising:

obtaining a threshold voltage of the driving transistor in the one of the multiple pixel circuits;

applying a testing voltage to a gate electrode of the driving transistor for charging the sense line up to a first time period to determine a first monitoring voltage associated with the sense line, wherein the testing voltage is set to be a sum of the threshold voltage and a first setting voltage; and compensating a data voltage to be applied to the one of the multiple pixel circuits based on the first monitoring voltage and the threshold voltage;

wherein the compensating the data voltage comprises dividing the data voltage to be applied to the one of the multiple pixel circuits by a first parameter and adding a second parameter to obtain a compensated data voltage, wherein the first parameter is equal to a square root of the first monitoring voltage divided by a first constant and the second parameter is equal to a sum of the threshold voltage and a second constant.

2. The method of claim 1, wherein the first time period is set to be a same duration for some of the multiple pixel circuits correspondingly for driving respective OLEDs thereof to emit light of a same color and the first setting voltage is set to be a same voltage for each of the some of the multiple pixel circuits.

3. The method of claim 1, wherein either the first time period is set to be a same duration for some of the multiple pixel circuits correspondingly for driving respective OLEDs thereof to emit light of a same color or the first setting voltage is set to be a same voltage for each of the some of the multiple pixel circuits.

4. The method of claim 1, wherein the obtaining the threshold voltage of the driving transistor comprises applying a second setting voltage to the gate of the driving transistor to charge the sense line up to a second time period to determine a second monitoring voltage associated with the sense line.

5. The method of claim 4, wherein the threshold voltage is determined to be equal to a difference between the second setting voltage and the second monitoring voltage.

6. The method of claim 1, further comprising repeating the obtaining a threshold voltage of the driving transistor and the applying a first testing voltage to determine a first monitoring voltage based on a triggering condition to obtain refreshed values of the threshold voltage and the first monitoring voltage; using the refreshed values for compensating the data voltage to be applied to the one of the multiple pixel circuits.

7. The method of claim 6, wherein the triggering condition comprises at least one selected from:

receiving a control command to request the repeating;

turning on the display apparatus;

being a first time before every n frames of images being displayed on the display apparatus, wherein n is a positive integer; and being a second time when a timer starts timing for measuring either the first time period or a second time period.

8. The method of claim 1, wherein the compensating the data voltage comprises making a first adjustment to the data voltage individually due to differences between different threshold voltages of different driving transistors in different pixel circuits correspondingly for driving respective OLEDs thereof to emit light of a same color and making a second adjustment to the data voltage individually due to differences between different device-parameters other than the threshold voltage of different driving transistors in different pixel circuits correspondingly for driving respective OLEDs thereof to emit light of the same color.

9. A method for driving a display apparatus, the display apparatus including multiple pixel circuits, a respective one of the multiple pixel circuits including a driving transistor, an organic light-emitting diode (OLED), and a sense line coupled to the driving transistor and the OLED, the method comprising:

applying a testing voltage individually to a gate of a driving transistor in a pixel circuit of the multiple pixel circuits, the testing voltage being a sum of a threshold voltage of the driving transistor and a first setting voltage;

charging the sense line coupled to the driving transistor by charges induced by the testing voltage;

converting the charges accumulated over a first time period to obtain a first monitoring voltage associated with the sense line, wherein the first monitoring voltage and the testing voltage are used to deduce one or more compensation parameters individually associated with the pixel circuit and used to compensate a data voltage to be applied to the pixel circuit for controlling the OLED thereof to emit light for displaying a subpixel image; and compensating a data voltage to be applied to the one of the multiple pixel circuits based on the first monitoring voltage and the threshold voltage;

wherein the compensating the data voltage comprises dividing the data voltage to be applied to the one of the multiple pixel circuits by a first parameter and adding a second parameter to obtain a compensated data voltage, wherein the first parameter is equal to a square root of the first monitoring voltage divided by a first constant and the second parameter is equal to a sum of the threshold voltage and a second constant.

10. The method of claim 9, wherein the first time period is set to be a same duration for each of some of the multiple pixel circuits corresponding to some of multiple sub-pixels for emitting light of a same color and the first setting voltage is set to be a same voltage for each of the some of the multiple pixel circuits.

11. The method of claim 9, wherein either the first time period is set to be a same duration for each of some of the multiple pixel circuits corresponding to some of multiple sub-pixels for emitting light of a same color or the first setting voltage is set to be a same voltage for each of the some of the multiple pixel circuits.

12. The method of claim 9, further comprising:

applying a second setting voltage to the gate of the driving transistor in the pixel circuit;

charging the sense line coupled to the driving transistor by charges induced by the second setting voltage; and converting the charges accumulated over a second time period to obtain a second monitoring voltage associated with the sense line, wherein the second monitoring voltage and the second setting voltage are used for deducing a threshold voltage associated with the driving transistor.

13. The method of claim 12, wherein the applying, charging, and converting are performed once a triggering condition is met for obtaining refreshed values of the first monitoring voltage and/or the second monitoring voltage for each of the multiple pixel circuits.

14. The method of claim 13, wherein the triggering condition comprises at least one selected from:

receiving a control command to request the refreshing;

turning on the display apparatus;

being a first time before every n frames of image is displayed on the display apparatus, wherein n is a positive integer; and being a second time when a programmed timing cycle starts.

15. A data voltage compensation apparatus of a display apparatus, the display apparatus including multiple pixel circuits, a respective one of the multiple pixel circuits including a driving transistor, an organic light-emitting diode (OLED), and a sense line coupled to the driving transistor and the OLED, the compensation apparatus comprising a compensator circuit coupled to a respective one of the multiple pixel circuits, wherein the compensator circuit is configured to;

obtain a threshold voltage individually associated with the driving transistor in one of the multiple pixel circuits;

apply a testing voltage to a gate of the driving transistor for charging the sense line up to a first time period to determine a first monitoring voltage associated with the sense line, wherein the testing voltage is set to be a sum of the threshold voltage and a first setting voltage; and compensate a data voltage to be applied to the pixel circuit based on the first monitoring voltage and the threshold voltage by dividing the data voltage to be applied to the one of the multiple pixel circuits by a first parameter and adding a second parameter to obtain a compensated data voltage;

wherein the first parameter is equal to a square root of the first monitoring voltage divided by a first constant and the second parameter is equal to a sum of the threshold voltage and a second constant.

16. A display apparatus comprising the data voltage compensation apparatus of claim 15.

17. A display-driving apparatus for driving a display apparatus, the display apparatus including multiple pixel circuits, each of the multiple pixel circuits including a driving transistor, an organic light-emitting diode (OLED), and a sense line coupled to the driving transistor and the OLED, the display-driving apparatus comprising a compensator circuit coupled to a respective one of the multiple pixel circuits, the compensator circuit comprising a monitor circuit, the monitor circuit is configured to;

sense charges in the sense line coupled to the driving transistor of a respective one of the multiple pixel circuits induced by a testing voltage applied to a gate of the driving transistor; and convert charges accumulated over a first time period to a readout voltage as a first monitoring voltage individually associated with the pixel circuit;

wherein the compensator circuit is configured to compensate a data voltage to be applied to the pixel circuit based on the first monitoring voltage and a threshold voltage by dividing the data voltage to be applied to the one of the multiple pixel circuits by a first parameter and adding a second parameter to obtain a compensated data voltage;

wherein the first parameter is equal to a square root of the first monitoring voltage divided by a first constant and the second parameter is equal to a sum of the threshold voltage and a second constant.

18. A display apparatus comprising the display-driving apparatus of claim 17.

* * * * *